United States Patent [19]

Shintaku

[11] 4,378,471

[45] Mar. 29, 1983

[54] HORN SPEAKER WITH LINEAR GROOVES IN A FRONT SURFACE OF A POLE PIECE OF A YOKE

[75] Inventor: Yoshishige Shintaku, Osaka, Japan

[73] Assignee: Ibuki Kogyo Co., Ltd., Osaka, Japan

[21] Appl. No.: 312,172

[22] Filed: Oct. 16, 1981

[30] Foreign Application Priority Data

Feb. 18, 1981 [JP] Japan ..... 56-22527

[51] Int. Cl.[3] ..... H04R 9/02

[52] U.S. Cl. ..... 179/119 R; 179/115.5 H; 181/177

[58] Field of Search ..... 179/115.5 R, 115.5 VC, 179/119 R, 115.5 ME, 114 R, 117; 181/159, 152, 177

[56] References Cited

U.S. PATENT DOCUMENTS 3,830,986 12/1972 Yamamuro ..... 179/119 R 4,336,425 6/1982 Renkus ..... 179/115.5 H

FOREIGN PATENT DOCUMENTS 902015 12/1953 Fed. Rep. of Germany ... 179/115.5 H 2822680 12/1978 Fed. Rep. of Germany ... 179/115.5 H

*Primary Examiner*—G. Z. Rubinson

*Assistant Examiner*—L. C. Schroeder

*Attorney, Agent, or Firm*—Poms, Smith, Lande & Rose

[57] ABSTRACT

A horn speaker wherein a pole piece of a yoke is arranged inside an annular permanent magnet and a moving coil which vibrates a diaphragm, is arranged in an air gap between the pole piece and the annular permanent magnet. A plurality of linear grooves are formed in the front surface of the pole piece in order to suppress the generation of the heat of the pole piece and the moving coil.

2 Claims, 2 Drawing Figures

HORN SPEAKER WITH LINEAR GROOVES IN A FRONT SURFACE OF A POLE PIECE OF A YOKE

BACKGROUND OF THE INVENTION

The present invention relates to a horn speaker and more particularly relates to a horn speaker having a yoke whose pole piece is provided with a plurality of linear grooves in its front end.

A conventional loud speaker for use in a siren for a ship or the like, is required a type having a possibly larger voice output. In order to obtain this effect a powerful permanent magnet is used in a horn-type speaker to obtain a good electro-acoustic transducing efficiency, and a larger voice current is adapted to be input.

However, since a moving voice coil is positioned in a narrow air gap between a pole piece of a circular yoke and a permanent magnet or an annular yoke which supports the permanent magnet in order to obtain a strong magnetic field, its cooling effect is bad during the operation.

Accordingly, the temperature of the pole piece of the circular yoke may be remarkably raised, for instance, up to more than 130° C., by the heat generated by the induced current of the moving coil vibrating and the heat of the moving coil itself. When the temperature of the pole piece is raised, the magnetic force is depressed, and thus the momentum of the moving coil is reduced. Consequently, the energy transform rate from the electric energy supplied in the form of the electric current into the kinetic energy is reduced, resulting in the increase of the heat generated of the moving coil.

Therefore, when an overinput is applied to the speaker or it is used continuously for a long period of time, the moving voice coil is often broken by overheat.

SUMMARY OF THE INVENTION

It is object of the present invention to provide a horn speaker having a yoke with a pole piece which is provided with a plurality of linear grooves in its front surface free from the aforementioned disadvantages, which is effective, compact and stable, and which suppresses the generation of the heat of the pole piece of the yoke and thus minimizes the temperature rise of the moving coil.

According to the present invention there is provided a horn speaker wherein a pole piece of a yoke is arranged inside an annular permanent magnet and a moving coil which vibrates a diaphragm, is arranged in an air gap between the pole piece and the annular permanent magnet, the improvement comprising a plurality of linear grooves formed in the front surface of the pole piece.

BRIEF DESCRIPTION OF DRAWINGS

In order that the present invention may be better understood, a preferred embodiment thereof will be described with reference to the accompanying drawings, in which.

DESCRIPTION OF A PREFERRED EMBODIMENT

Figure 1:
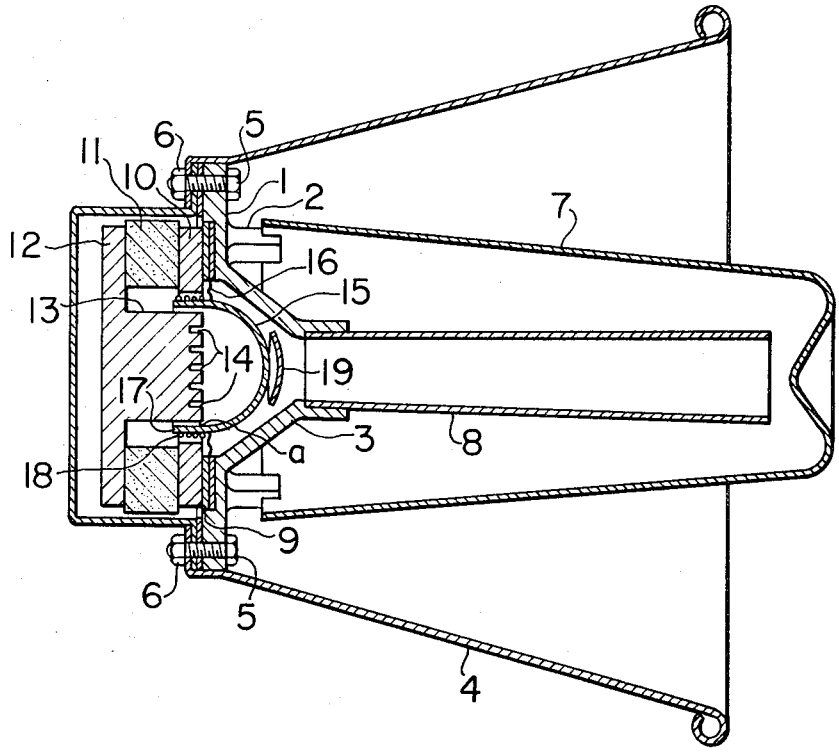
FIG. 1 is a central longitudinal cross-section of one embodiment of a horn speaker according to the present invention.

Referring now to the drawings there is shown in FIG. 1 one embodiment of a horn speaker according to the present invention.

An annular base plate 1 is provided with several brackets 2 for supporting a tubular reflector 7 on its front surface. A funnel-shaped support cylinder 3 for supporting an inner horn 8, whose diameter contracts frontward, is integrally connected to the inner periphery of the base plate 1.

An outer cylindrical horn 4 expanding frontward is mounted to the outer periphery of the base plate 1 in its base part by means of bolts 5 and nuts 6. The tubular reflector 7 expanding rearwards and having a closed front end is supported in its open rear end inside the outer horn 4 by the brackets 2. The rear end of the tubular inner horn 8 expanding frontward slightly is mounted to the front end of the support cylinder 3.

Behind the base plate 1, a retainer ring 9, an annular yoke 10, an annular permanent magnet 11, and a circular yoke 12 are mounted one on another. The circular yoke 12 is provided with a center pole or pole piece 13 which projects forward in its center so that a narrow annular air gap (a) may be formed between the annular yoke 10 and the front portion of the pole piece 13.

The pole piece 13 is provided with a plurality of linear grooves 14 in its front surface, which are arranged in parallel with one another. Each linear groove 14 possesses a width of 1 mm and a depth of 5 mm and is separated at a distance of 5 mm away from the adjacent ones. However, these dimentions and shapes are only one example, and therefore can, of course, be varied, as occasion demands.

In the space between the support cylinder 2 and the front of the pole piece 13, a diaphragm 15 having a half-spherical shape extending frontward is arranged and supported by an annular damper 16 which is mounted between the base plate 1 and the retainer ring 9.

A bobbin 17 is integrally connected to the rear end of the diaphragm 15 and is inserted in the gap (a) between the annular yoke 10 and the pole piece 13. A moving voice coil 18 for vibrating the diaphragm 15 is wound around the outer surface of the bobbin 17. An equalizer 19 is arranged in front of the diaphragm 15 apart a little therefrom.

Figure 2:
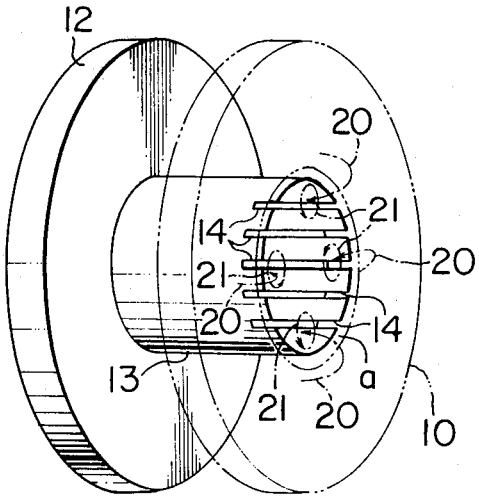
FIG. 2 is a perspective view of a circular yoke of FIG. 1, seen from the front side.

When the electric current is supplied to the moving coil 18 of the speaker described above, as shown in FIG. 2, a leakage magnetic flux 20 is caused in a space between the fronts of the annular yoke 10 and the pole piece 13 and it bends in front of the gap (a).

When the moving coil 18 is vibrated by the voice current supplied, eddy currents 21 flow in the front surface of the pole piece 13 across the leakage magnetic flux 20 in such a direction as to restrain the vibration of the moving coil 18 and thus to heat the pole piece 13.

However, the linear grooves 14 formed in the front surface of the pole piece 13 suppress the generation of the eddy currents. Accordingly, the generation of the heat of the pole piece 13 is little, and hence the moving coil 18 is maintained to a relatively low temperature. Therefore, this kind of speaker can be used in a large output by supplying a larger voice current to the moving coil 18 as compared with a conventional speaker. Depending on the actual measurement in this embodiment the voice pressure is similar to that of the conventional speaker of the same size, but the temperature rise of the pole piece 13 is approximately 10° C. lesser than the conventional one, which is very effective.

Although the present invention has been described with reference to a preferred embodiment thereof, various changes and modifications can be made by those skilled in the art without departing from the scope of the present invention.

What is claimed is:

1. A horn speaker wherein a pole piece of a yoke is arranged inside an annular permanent magnet and a moving coil which vibrates a diaphragm, is arranged in an air gap between the pole piece and the annular permanent magnet, the improvement comprising a plurality of linear grooves formed in the front surface of the pole piece.

2. A horn speaker as defined in claim 1, wherein the linear grooves arranged in parallel with one another.

* * * * *